United States Patent [19]

DeBruyn

[11] Patent Number: 4,692,964

[45] Date of Patent: Sep. 15, 1987

[54] CONCEALED SELF-CLOSING HINGE

[75] Inventor: William DeBruyn, Rockford, Ill.

[73] Assignee: Amerock Corporation, Rockford, Ill.

[21] Appl. No.: 836,248

[22] Filed: Mar. 5, 1986

[51] Int. Cl.[4] ..... E05D 3/10

[52] U.S. Cl. ..... 16/367; 16/72

[58] Field of Search ..... 16/367, 238, 240, 245, 16/72, 73, 76

[56] References Cited

U.S. PATENT DOCUMENTS

| | | | |
|---|---|---|---|
| 1,100,684 | 6/1914 | Stoakes | 16/367 |
| 1,887,549 | 11/1932 | Ervin | 16/367 |
| 2,085,616 | 6/1937 | Voge | 16/367 |
| 3,763,519 | 10/1973 | Favre | 16/72 |
| 3,840,936 | 10/1974 | Sato | 16/76 |
| 4,007,514 | 2/1977 | Salice | 16/240 |
| 4,111,027 | 9/1978 | Bottomley | 72/320 |
| 4,359,802 | 11/1982 | Rock | 16/238 |

FOREIGN PATENT DOCUMENTS

| | | | |
|---|---|---|---|
| 1409898 | 7/1965 | France | 16/367 |

OTHER PUBLICATIONS

Amerock Corporation Catalog No. CM-3029 entitled *Concealed Hinges.*

Amerock Corporation Specification Sheets Nos. CM-3056 and CM-3057.

*Primary Examiner*—E. R. Kazenske

*Assistant Examiner*—James L. Wolfe

*Attorney, Agent, or Firm*—Leydig, Voit & Mayer

[57] ABSTRACT

A fully concealed, self-closing hinge for mounting a cabinet door to open through an angle of about 175 degrees on a cabinet frame, the hinge having only two pivoted links and three pivot axes. One link is connected to pivot relative to the door about one axis, the other link is connected to pivot relative to the frame about a second axis, and the two links are connected together to pivot relative to one another about the third axis. All three axes intersect one another at a common point on the hinge axis of the door in all positions of the door and constrain the door to swing in an arc about the hinge axis while enabling wide-angle opening of the door.

12 Claims, 27 Drawing Figures

CONCEALED SELF-CLOSING HINGE

BACKGROUND OF THE INVENTION

This invention relates generally to hinge means and, more particularly, to hinge means for mounting an element such as a door for swinging between open and closed positions on an element such as a cabinet.

In certain so-called European-style cabinets, the door is mounted on the cabinet by hinges which are fully concealed from the front and sides of the cabinet when the door is fully closed. Prior fully concealed hinges of this type are comparatively large and complex and require a significant amount of material. For example, a hinge which enables the door to be opened through approximately 175 degrees generally requires a linkage mechanism with as many as seven parallel pivots or requires a linkage mechanism with six parallel pivots and a slide. Another type of a prior fully concealed hinge has a somewhat simplified linkage mechanism with only four parallel pivots but such a hinge generally does not permit the door to be opened beyond approximately 125 degrees.

The complexity of the prior fully concealed hinges is increased even further when the hinges are of the self-closing type. A self-closing hinge includes a spring mechanism which acts to swing the door to its fully closed position once the door has been closed part way.

SUMMARY OF THE INVENTION

The general aim of the present invention is to provide a new and improved fully concealed and self-closing hinge which, when compared with prior hinges of the same general type, is far simpler and less expensive in construction, requires fewer parts and less material and is capable of permitting the door to open widely through an angle in the neighborhood of 175 degrees.

A more detailed object of the invention is to achieve the foregoing through the provision of a self-closing hinge having only three pivots which are uniquely arranged to enable the door to open through approximately 175 degrees while still enabling all parts of the hinge to be fully concealed from the front and the sides of the cabinet when the door is closed.

In still a more specific sense, the invention involves a self-closing hinge in which one end of an elongated door link is supported on a door member to pivot about a first axis, in which one end of an elongated frame link is supported on a frame member to pivot about a second axis, and in which the other ends of the links are connected to one another to pivot about a third axis. All three pivot axes intersect one another at a point which lies along the hinge axis of the door and all remain in intersecting relation with such point in all positions of the door so as to cause the door to swing in an arc about the hinge axis.

The invention also resides in the provision of novel and relatively compact but effective mechanism which acts between the links to effect self-closing of the door.

These and other objects and advantages of the invention will become more apparent from the following detailed description when taken in conjunction with the accompanying drawings.

DETAILED DESCRIPTION OF THE PREFERRED EMBODIMENTS

Figure 4:
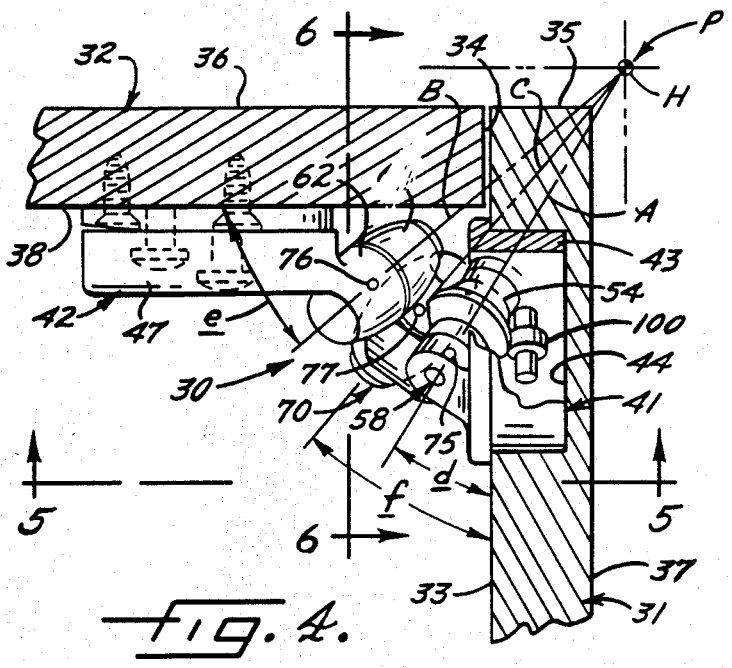
FIG. 4 is an enlarged fragmentary cross-section taken substantially along the line 4—4 of FIG. 1.
Figure 5:
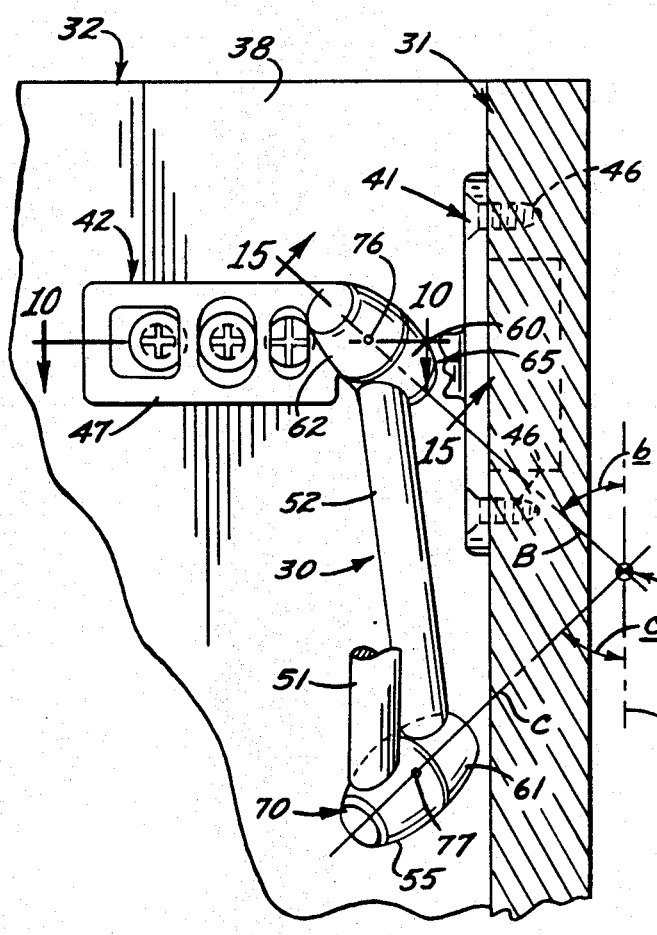
FIGS. 5 and 6 are enlarged fragmentary cross-sections taken substantially along the lines 5—5 and 6—6, respectively, of FIG. 4.
Figure 6:
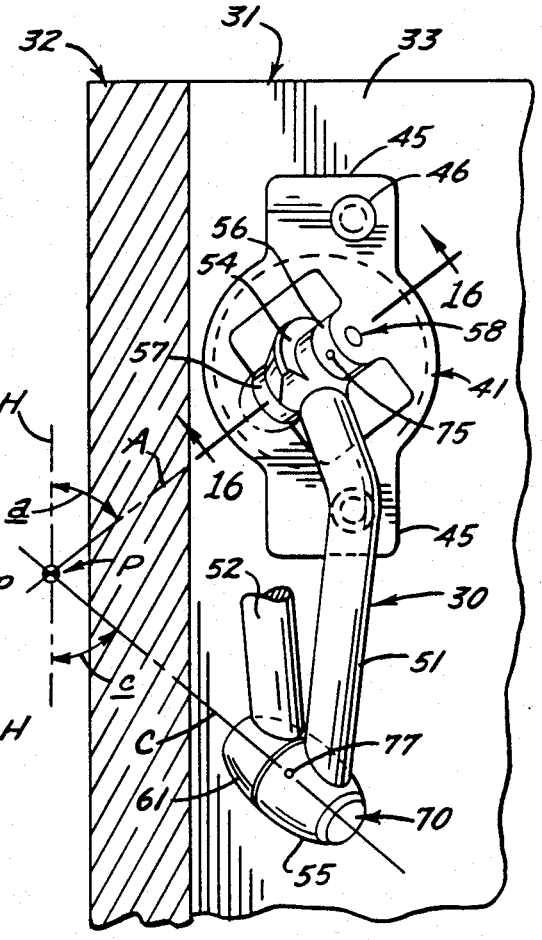
Figure 7:
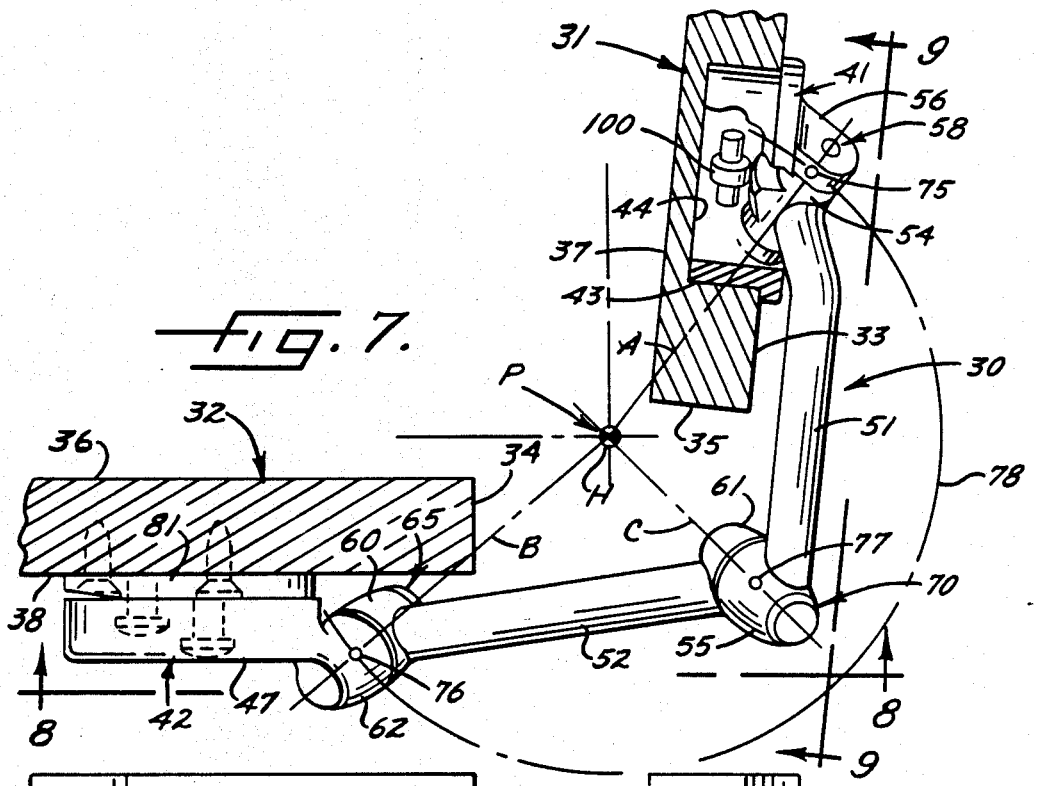
FIG. 7 is an enlarged fragmentary cross-section taken substantially along the line 7—7 of FIG. 3.
Figure 8:
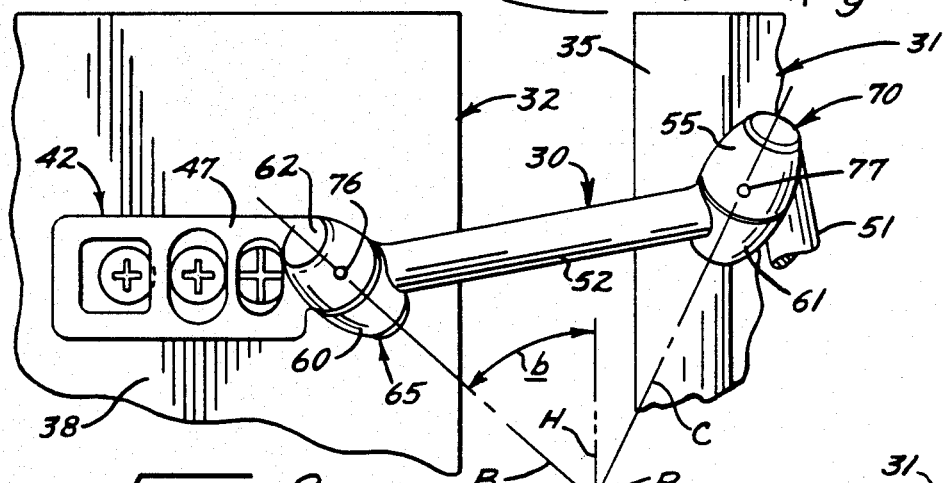
FIGS. 8 and 9 are enlarged fragmentary elevational views taken substantially along the lines 8—8 and 9—9, respectively, of FIG. 7.
Figure 9:
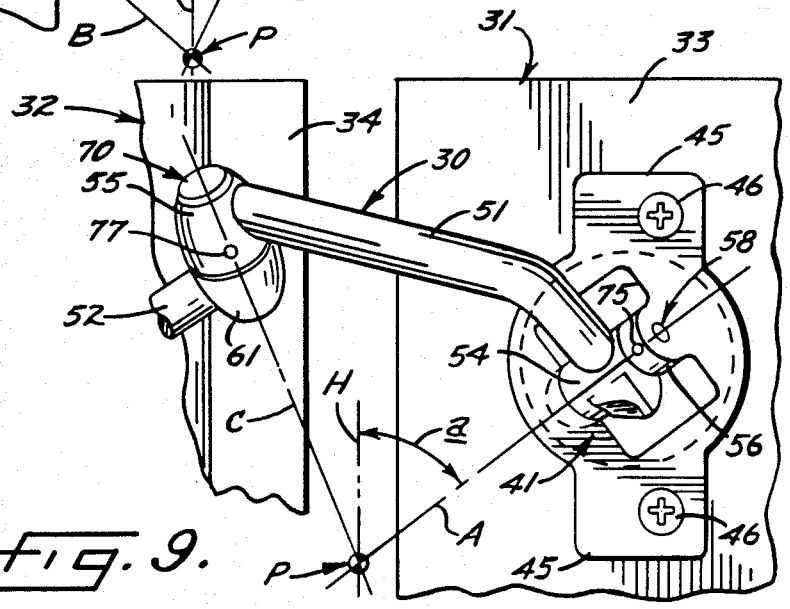

As shown in the drawings for purposes of illustration, the invention is embodied in a hinge 30 which, in the present instance, serves to mount an upright door element 31 on an upright frame element 32 to swing between a fully closed position (FIG. 1) and a fully open position (FIG. 3) about a generally vertical hinge axis H (FIGS. 5 and 6). The door 31 may, for example, be a cabinet door while the frame 32 may form one side panel of the cabinet. Herein, the door is of the full overlay type in that, when the door is fully closed, its inside face surface 33 (FIG. 4) opposes the outer edge surface 34 of the frame while its edge surface 35 lies flush with the outside face surface 36 of the frame. The outside face surface of the door 31 has been indicated by the reference numeral 37 and the inside face surface of the frame 32 has been indicated by the reference numeral 38. The inside face surfaces 33 and 38 are generally perpendicular to one another when the door is fully closed.

The hinge 30 is a top hinge and is mounted adjacent the upper end portions of the door 31 and the frame 32. A bottom hinge 30*a* (FIGS. 1 to 3) is mounted adjacent the lower end portions of the door and the frame and coacts with the top hinge to establish the vertical axis H about which the door swings. The bottom hinge is very similar to the top hinge and thus only the top hinge will be described in detail. Thereafter, the bottom hinge will be described briefly.

In general, the hinge 30 includes door and frame members 41 and 42 adapted to be secured rigidly to the door 31 and the frame 32, respectively. The door member comprises an inwardly opening and generally cylindrical cup 43 (FIGS. 4 and 16) which is received in a similarly shaped pocket 44 formed in the inside or mounting face 38 of the door adjacent the edge surface 35 thereof. The cup terminates short of the outside face 37 of the door and thus the cup is completely concealed from view from the outside of the cabinet when the door is fully closed. Vertically extending flanges 45 (FIG. 6) are formed integrally with the inner lip of the cup and receive mounting screws 46 which anchor the door member 41 securely to the door.

The frame member 42 of the hinge 30 will be described in detail subsequently. For the present, it will suffice to say that the frame member 42 includes a generally dish-shaped cover piece 47 which is rigidly secured to the inside or mounting face 38 of the frame 32. The frame member 42 of the hinge also is completely concealed from view from outside the cabinet when the door 31 is fully closed.

In accordance with one aspect of the present invention, the cost and complexity of a fully concealed hinge 30 of the foregoing type are reduced significantly by constructing the hinge 30 with only two links 51 and 52 and with only three pivot axes A, B and C. The three pivot axes are uniquely located to enable the links to control swinging of the door 31 in a true arc about the vertical hinge axis H and through a wide angle in the neighborhood of 175 degrees. Because the hinge contains fewer parts and fewer pivot axes than prior hinges of the same general type, the hinge can be manufactured at significantly less cost.

Figure 16:
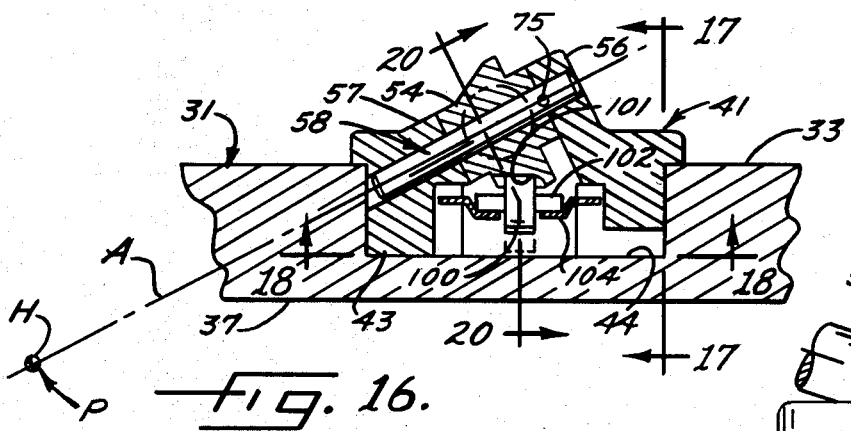
FIG. 16 is an enlarged fragmentary cross-section taken substantially along the line 16—16 of FIG. 6.
Figure 17:
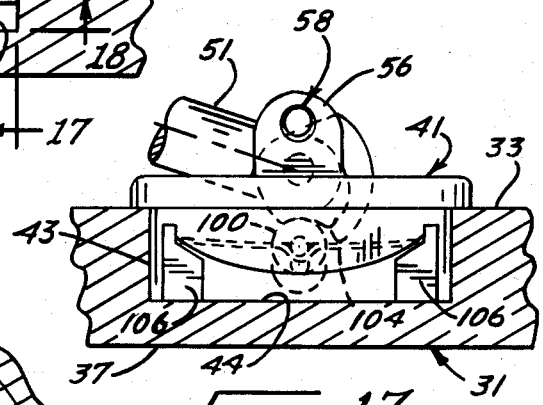
FIGS. 17 and 18 are fragmentary cross-sections taken substantially along the line 17—17 and 18—18 of FIG. 16.
Figure 18:
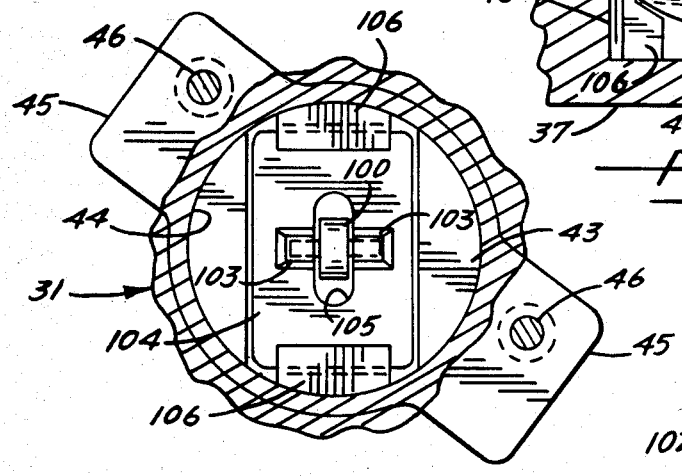

Specifically, the link 51 is a door link which is supported to pivot relative to the door member 41 of the hinge 30 about the axis A. The door link is shaped as an elongated cylindrical rod having one end formed with an enlarged head 54 (FIGS. 6 and 16). Formed integrally with the opposite end of the rod of the link 51 is a tubular hub 55.

To support the door link 51 to pivot relative to the door member 31 about the axis A, the cup 43 of the door member is formed with two ears 56 and 57 (FIGS. 6 and 16) which are spaced from one another so as to receive the head 54 of the door link. A hinge pin 58 whose axis coincides with the axis A extends through holes in the ears 56 and 57 and a hole in the head 54 and supports the link 51 to swing relative to the door member 31 about the axis A. Typically the hinge pin 58 is anchored rigidly within the holes in the ears 56 and 57 so that the link 51 pivots freely on the pin.

Figure 15:
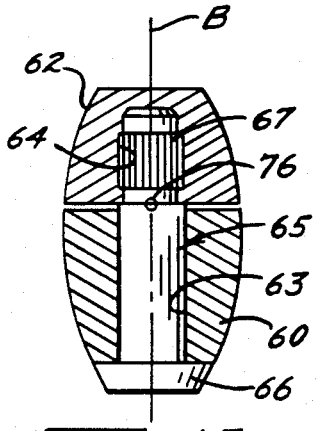
FIG. 15 is an enlarged cross-section taken substantially along the line 15—15 of FIG. 5.
Figure 13:
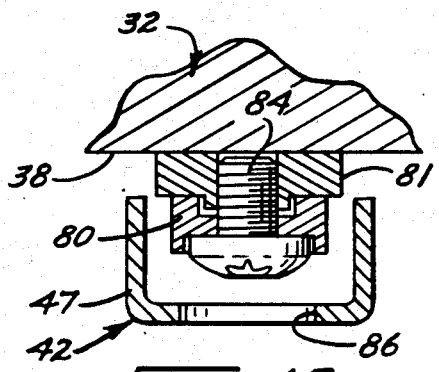

The frame link 52 is supported to pivot relative to the frame member 32 about the axis B. The frame link 52 also is shaped as an elongated cylindrical rod having one end formed with an integral hub 60, the opposite end of the rod also being formed with a somewhat similar integral hub 61. Yet another hub 62 is formed integrally with one end of the dish-shaped piece 47 of the frame member 42 and lies adjacent the hub 60 of the link 52 as shown in FIG. 15. The hubs 60 and 62 are formed with holes 63 and 64, respectively, which receive a hinge pin 65 having an axis which coincides with the axis B. One end of the hinge pin 65 is formed with a head 66 which engages the hub 60 while the opposite end portion of the hinge pin is formed with an enlarged diameter knurled surface 67 which telescopes into the hole 64 with a tight press fit. The hub 60 turns freely on the fixed hinge pin 65 to enable the link 52 to pivot relative to the frame member 32 about the axis B.

A hinge pin 70 (FIGS. 5 and 6) connects the hub 55 of the link 51 to the hub 61 of the link 52 to enable the two links to pivot relative to one another about the third axis C. The hinge pin 70 is similar to the hinge pin 65 while the hubs 55 and 61 are generally similar to the hubs 60 and 62, respectively. Thus, the hinge pin 70 is anchored within the hub 61 while the hub 55 turns freely on the pin. The axis of the pin 70 coincides with the axis C.

In carrying out the invention, the axes A, B and C are located such that they all intersect one another at a common point P (FIGS. 4 to 9) on the vertical hinge axis H and remain in intersecting relation with the point P at all times as the door 31 is swung from its fully closed position to its fully open position. As a result, the hinge 30, together with the lower hinge 30*a*, constrains the door to swing in an arc around the vertical hinge axis H and enables the door to swing through a relatively large angle (e.g., 175 degrees) even though the hinge 30 only includes three pivot axes.

In order to cause the axes A, B and C to intersect one another at the point P on the vertical hinge axis H, the upper hinge pin 58 of the door link 51 is located above the point P and preferably is vertically inclined so as to cause the axis A to slope downwardly as the axis progresses toward the point P. In this particular instance, the axis A is inclined relative to vertical at an angle a (FIG. 6) of about 57 degrees although the specific angle of inclination is not critical and can vary in accordance with changes in other design considerations. In addition to being vertically inclined, the axis A preferably is disposed in oblique or non-parallel relation with the plane of the inside face surface 33 of the door 31 and, in this particular instance, is inclined relative to the inside face surface at an angle d (FIG. 4) of about 32 degrees.

The hinge pin 65 of the frame link 52 also is located above the point P and, like the pin 58, is preferably inclined vertically so as to cause the axis B to slope downwardly as the latter axis approaches the point P. The axis B is inclined relative to vertical at an angle b (FIG. 5) which, in this instance, is also approximately 57 degrees. Moreover, the axis B is preferably located in oblique or non-parallel relation with the plane of the inside face surface 38 of the frame 32 and herein is inclined at an angle e (FIG. 4) of about 40 degrees relative to the inside face surface.

By virtue of the angles d and e, the axes A and B converge toward one another as they progress downwardly toward the point P (see FIG. 4). Because the axes A and B are inclined vertically at the angles a and b, they intersect one another at the point P when the door 31 is fully closed.

The hinge pin 70 connects the links 51 and 52 to one another and causes the links 51 and 52 to pivot about the axes A and B, respectively, when the door 31 is swung between its closed and open positions. In addition, the hinge pin 70 coacts with the lower hinge 30*a* to keep the axes A and B in intersecting relation with the point P at all times during the full range of swinging of the door and to cause the point P to lie along the vertical hinge axis H about which the door swings. For these purposes, the hinge pin 70 is located so as to cause the axis C to be inclined relative to the inside face surface 33 of the door 31 at an angle f (FIG. 4) of about 41 degrees when the door is in its fully closed position. When the door is fully closed, the axis C slopes upwardly as it progresses toward the point P and is inclined relative to vertical at an angle c which causes the axis C to intersect the point P. The angle c herein is on the order of 57 degrees when the door is fully closed.

The lower hinge 30*a* could be identical in all respects to the upper hinge 30. Preferably, however, the lower hinge is essentially an inverted duplicate of the upper hinge. Thus, the door and frame links 51*a* and 52*a* of the lower hinge extend upwardly from the door and frame members 41*a* and 42*a*, respectively, when the door 31 is in its fully closed position. The lower hinge includes three pivot axes A', B' and C' which always intersect one another at a point (not visible) located upwardly from the door and frame members 41a and 42*a*. That point coacts with the point P to establish the location of the hinge axis H, that is to say, the hinge axis H extends substantially vertically through the two points.

With the foregoing arrangement, the point P lies on the hinge axis H and defines the origin or center of an imaginary sphere. The axes A, B and C all radiate from the point P and all penetrate the sphere at given points along the axes. For purposes of explanation, let it be assumed that the axis A penetrates the sphere at imaginary point 75 (FIG. 7), that the axis B penetrates the sphere at imaginary point 76 and that the axis C penetrates the sphere at imaginary point 77. The point 76 on the axis B remains at a fixed location on the sphere at all times.

As the door 31 starts swinging from its closed position (FIGS. 1 and 4 to 6) toward its open position (FIGS. 3 and 7 to 9) the link 51 acts through the hinge pin 70 to cause the link 52 to swing upwardly about the fixed axis B as permitted by the hinge pin 65. The link 51 also swings upwardly about the axis A as permitted by the hinge pin 58 and, at the same time, the point 75 on the axis A travels around the imaginary sphere in a substantially horizontal arc 78 (FIG. 7) about the hinge axis H. During upward swinging of the links 51 and 52, the axis C defined by the hinge pin 70 moves generally upwardly such that the point 77 along such axis swings about the center point P and moves along the surface of the aforesaid imaginary sphere. When the door 31 has been opened to 90 degrees, the axis C extends substantially perpendicular to the hinge axis H as shown in FIG. 2 while the axes A and B continue to obliquely intersect the hinge axis H.

With further swinging of the door 31 from its 90-degree partially open position (FIG. 2) to its approximately 175-degree full open position (FIG. 3), the axes A and C continue to move as described immediately above. When the door reaches its fully open position, the links 51 and 52 extend upwardly from the door and frame members 41 and 42, respectively, while the axis C slopes downwardly as it progresses toward the center point P (see FIG. 3 and FIGS. 8 and 9).

Figure 1:
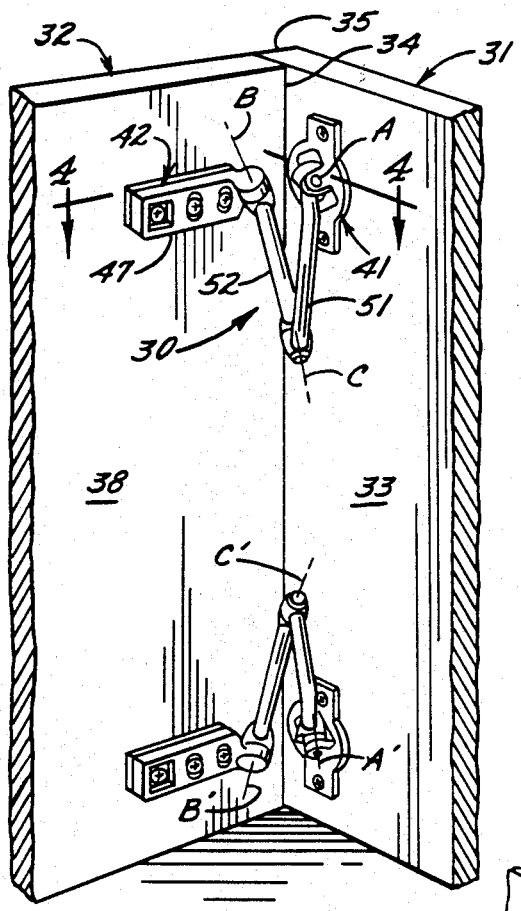
FIG. 1 is a fragmentary perspective view which illustrates typical door and cabinet elements equipped with new and improved hinges incorporating the unique features of the present invention, the door being shown in a fully closed position.
Figure 2:
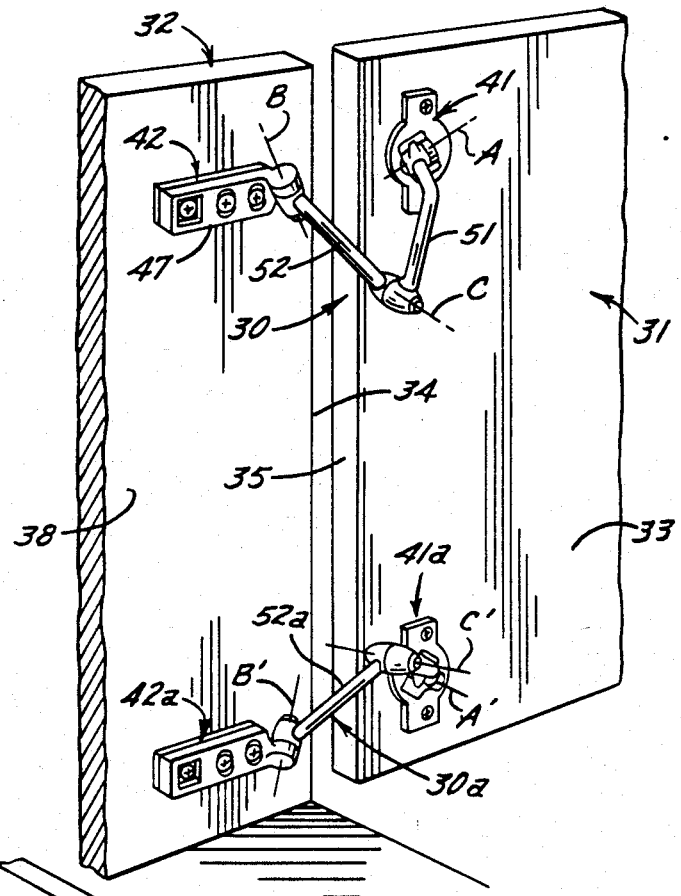
FIG. 2 is a view similar to FIG. 1 but shows the door approximately half-way open.
Figure 3:
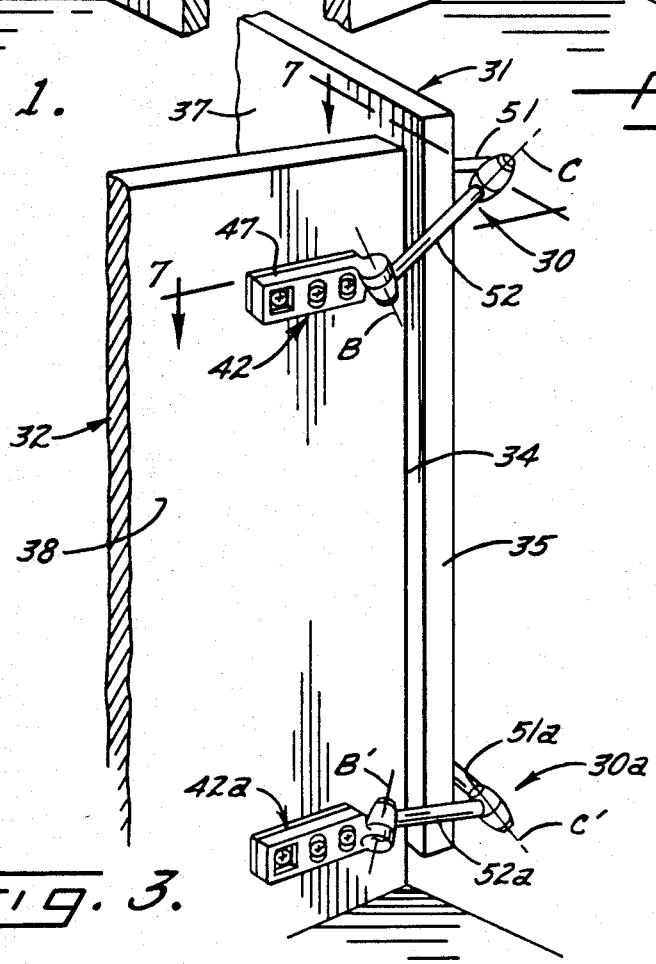
FIG. 3 also is a view similar to FIG. 1 but shows the door fully open.

The lower hinge 30*a* operates in the same manner as the upper hinge 30 except that the links 51*a* and 52*a* of the lower hinge pivot from upwardly extending positions to downwardly extending positions as the door swings from closed to open (compare FIGS. 1 and 3). Because the lower hinge 30*a* is an inverted duplicate of the upper hinge 30, its links extend upwardly in the closed position of the door and thus its door and frame members 41*a* and 42*a* may be located more nearly adjacent the lower edges of the door 31 and the frame 32 than otherwise would be the case if the lower hinge were identical to the upper hinge.

From the foregoing, it will be apparent that the hinges 30 and 30*a* are fully concealed from the outside of the cabinet when the door 31 is closed, that the hinges permit the door to open in an arc and through an angle of about 175 degrees and that each hinge requires only two links and three pivot axes by virtue of such axes continuously intersecting one another at the common point P. The hinges are, therefore, significantly less complex and less expensive than prior fully concealed hinges which permit wide-angle opening of the door. Of course, it will be appreciated that the hinges can be designed to permit opening of the door to any angle between 90 degrees and approximately 175 degrees and that the hinges may be made even more compact if the opening angle is reduced.

Figure 10:
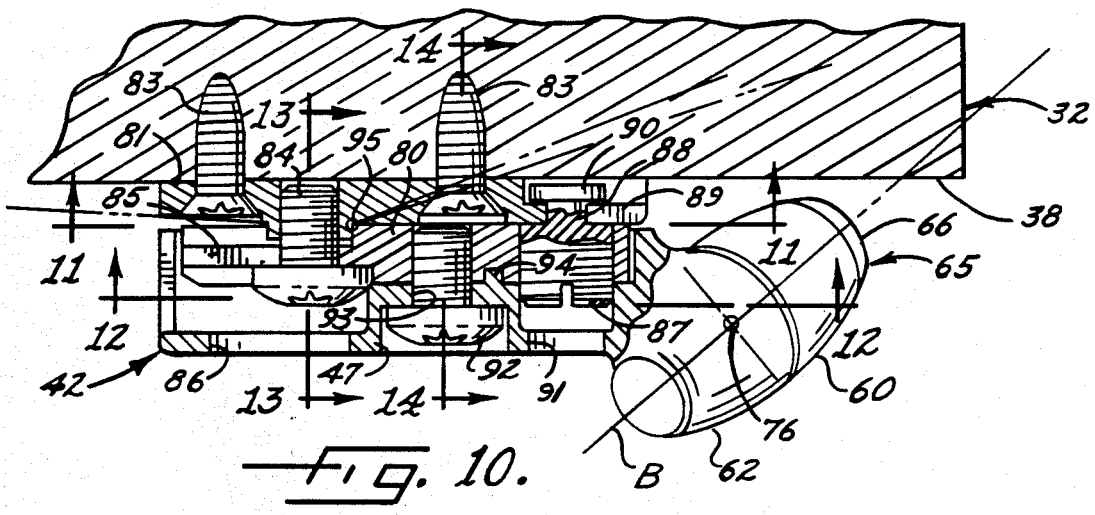
FIG. 10 is an enlarged fragmentary cross-section taken substantially along the line 10—10 of FIG. 5.
Figure 11:
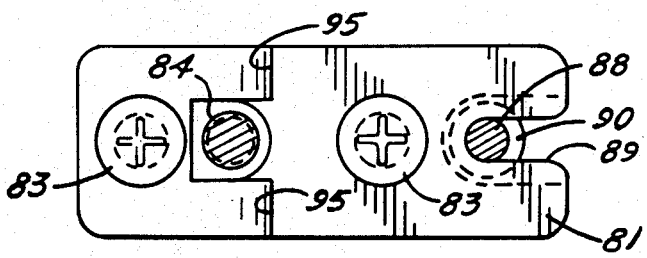
FIGS. 11, 12, 13 and 14 are cross-sections taken substantially along the lines 11—11, 12—12, 13—13 and 14—14, respectively, of FIG. 10.
Figure 12:
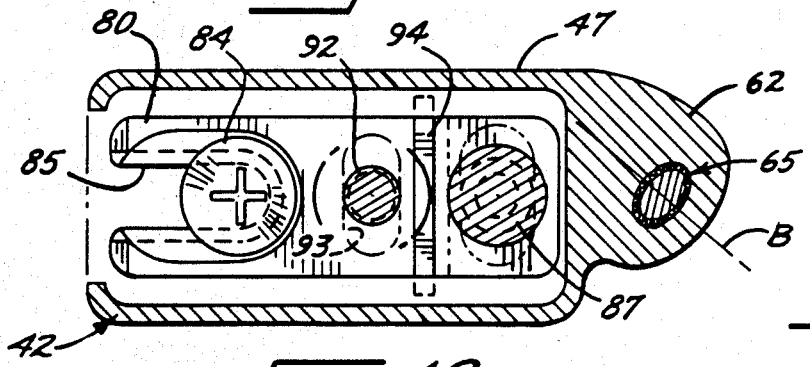

Means are provided to permit the hinge 30 to be adjusted vertically and horizontally and also angularly in order to enable the point P to be properly established and to enable the door 31 to be alined properly with the frame 32. Herein, these means comprise the dish-shaped cover 47 of the frame member 42, a slide 80 (FIG. 10) and a base plate 81; the slide and base plate also forming part of the door member 42. As shown in FIGS. 10 and 11, the base plate 81 is a substantially flat member which is secured rigidly to the inner side of the frame 32 by screws 83. The slide 80 lies against the base plate and is secured to the base plate by a screw 84 extending through a laterally elongated slot 85 in the slide and threaded into the base plate. An opening 86 in the cover 47 permits access to the head of the screw 84.

The slide 80 and the base plate 81 also are connected by a set screw 87 (FIG. 10) threaded into the slide and formed with a shank 88 which extends through a laterally elongated slot 89 (FIG. 11) in the base plate. Formed on the end of the shank is a head 90 which is engageable with the base plate. An opening 91 in the cover permits access to the screw 87.

Figure 14:
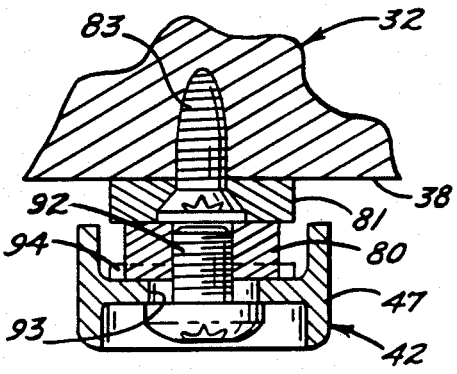

A screw 92 (FIGS. 10 and 14) extends through a vertically elongated slot 93 in the cover 47 and is threaded into the slide 80 to secure the cover to the slide. The cover is guided for vertical movement on the slide by a key 94 formed integrally with the cover and fitting in a vertical keyway in the slide.

With the foregoing arrangement, the screw 92 may be loosened and the cover 47 may be adjusted upwardly or downwardly as permitted by the slot 93 to change the elevation of the hinge pin 65 relative to the frame 32. When the screws 92 of both hinges are loose, the door 31 may be shifted upwardly or downwardly relative to the frame 32 to bring the top and bottom edges of the door into alinement with the top and bottom edges of the frame.

Loosening of the screw 84 enables the cover 47 and the slide 80 to be shifted laterally in unison relative to the frame 32 as permitted by the slots 85 and 89 so that, when the screws of both hinges are loose, the door 31 may be adjusted inwardly or outwardly as may be necessary to cause the inside face surface 33 of the door to lie closely adjacent the edge surface 34 of the frame 32. When the screw 87 is adjusted, it causes the cover 47 and the slide 80 to pivot as a unit about a fulcrum 95 (FIGS. 10 and 11) on the base plate 81. Accordingly, the angular position of the frame member 42 may be adjusted to enable the hinge axis H to lie along a vertical line and to effect alinement of the edge surface 35 of the door with the outside face surface 36 of the frame.

The present invention also contemplates the provision of means for causing the door 31 to close automatically after the door has been swung part way toward its closed position. In the embodiment of the hinge 30 shown in FIGS. 1 to 21, these means comprise a roller 100 (FIGS. 16 to 21) carried by the cup 43 and spring-urged against a cam surface 101 on the head 54 of the door link 51.

Figure 19:
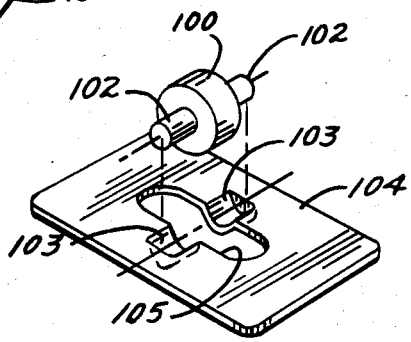
FIG. 19 is an exploded perspective view of certain parts shown in FIG. 18.
Figure 20:
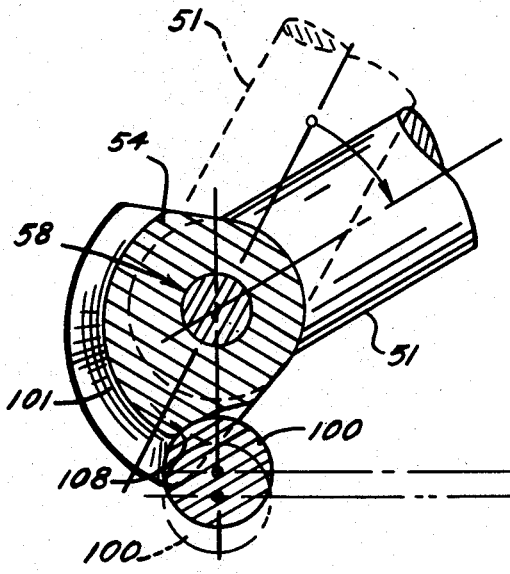
FIG. 20 is an enlarged fragmentary cross-section taken substantially along the line 20—20 of FIG. 16.

More specifically, the roller 100 is a cylindrical member which carries a pair of oppositely extending trunnions 102 (FIG. 19). The latter are journaled in grooves 103 formed in an initially flat leaf spring 104. An opening 105 is formed in the spring to enable the roller to project through the spring.

The end portions of the spring 104 are supported by a pair of lugs 106 (FIG. 18) within the cup 43 of the door member 41. The lugs and the spring coact to hold the roller 100 against the cam surface 101 on the head 54.

Figure 21:
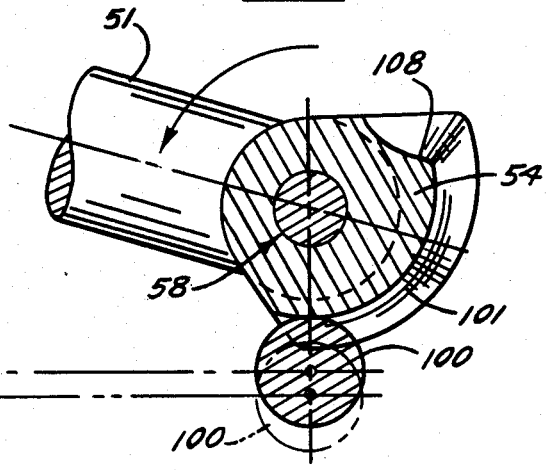
FIG. 21 is a view similar to FIG. 20 but shows certain parts in moved positions.
Figure 22:
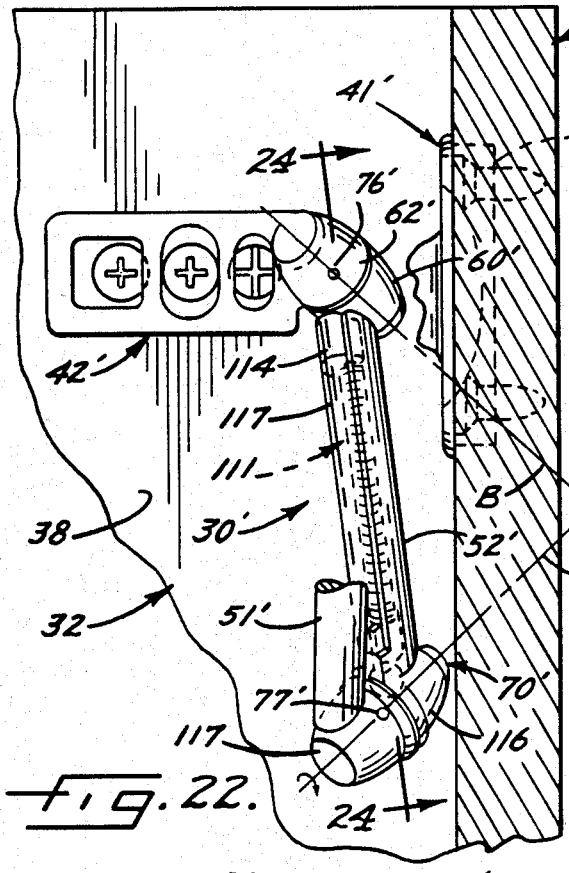
FIG. 22 is a view similar to FIG. 5 but shows a second embodiment of a hinge incorporating the features of the invention.
Figure 24:
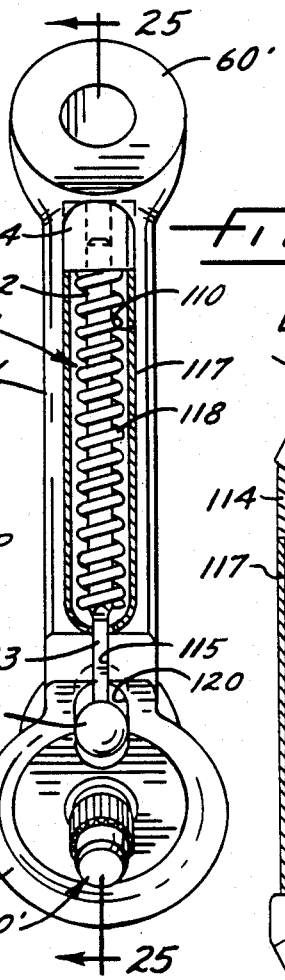
FIG. 24 is an enlarged cross-section taken substantially along the line 24—24 of FIG. 22.
Figure 23:
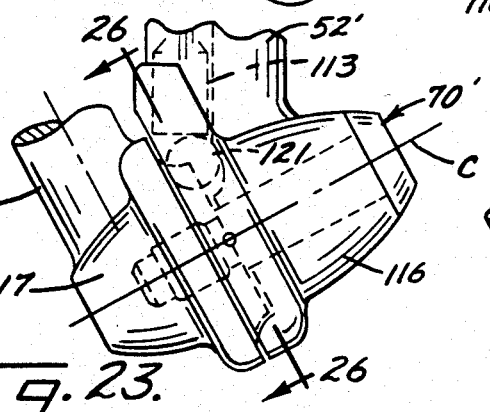
FIG. 23 is an enlarged fragmentary view of certain parts shown in FIG. 22 but illustrates such parts in a slightly different plane.
Figure 25:
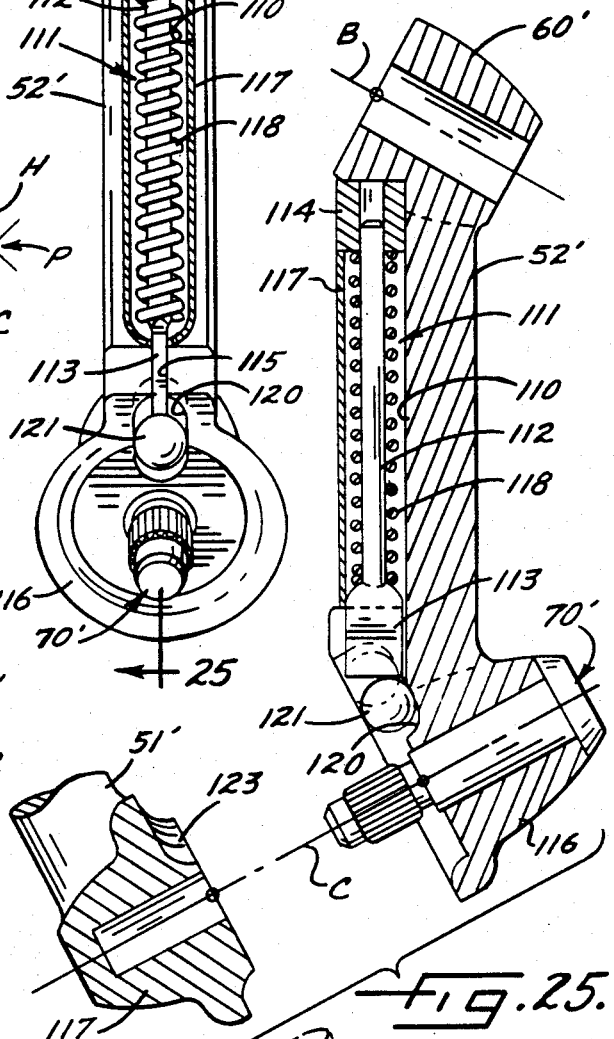
FIG. 25 is an enlarged cross-section taken substantially along the line 25—25 of FIG. 24 and shows another part of the hinge in exploded relation.
Figure 26:
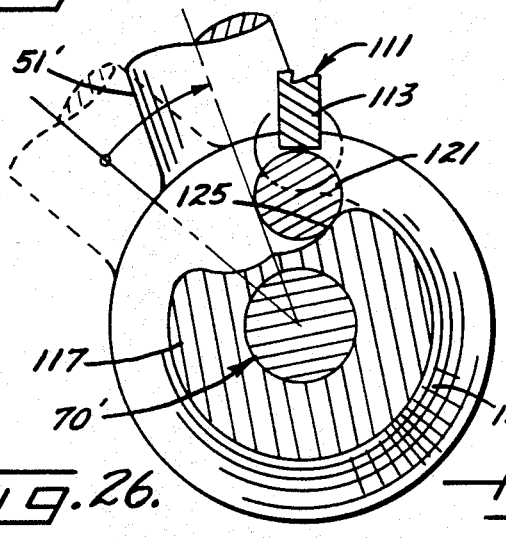
FIG. 26 is an enlarged fragmentary cross-section taken substantially along the line 26—26 of FIG. 23.

As the door 31 is opened, the door link 51 swings to the position shown in FIG. 21 and causes the cam surface 101 to bear against the roller 100 and load the spring 104 by bowing the spring between the lugs 106. As the door is closed, the cam surface 101 rides in the opposite direction along the roller and, when the door is about 30 degrees from being fully closed, the door link 51 and the cam surface 101 are positioned as shown in phantom in FIG. 20. At this time, the roller 100 encounters a rather abrupt fall 108 in the cam surface to release the energy stored in the spring 104. The spring presses the roller against the cam fall to produce a camming action which snaps the door closed.

A modified hinge 30' with a different self-closing mechanism is shown in FIGS. 22 to 27 in which parts corresponding to parts of the hinge 30 of the first embodiment are indicated by the same but primed reference numerals. The hinge 30' is characterized in that the self-closing mechanism acts directly between the two links 51' and 52' and thus causes less stress to be applied to the hinge as compared to the hinge 30 where the self-closing mechanism acts between the door member 41 and one end of the door link 51. Also, a smaller spring may be used to effect the self-closing.

To achieve the foregoing, the inside face of the frame link 52' is formed with a cavity or groove 110 (FIG. 25) which receives a plunger 111 having an elongated stem 112 with an enlarged head 113 at its lower end. The upper end portion of the stem is slidably guided in a bushing 114 secured within the groove 110 adjacent the hub 60' of the frame link 52'. The head 113 is slidably guided in a slot 115 (FIG. 24) formed in the opposite end portion of the link adjacent a hub 116. A hinge pin 70' extends through the hub 116 and pivotally couples the latter to a hub 117 on the lower end of the door link 51'.

A cover 117 (FIGS. 24 and 25) fits within the groove 110 to conceal the plunger 111. The plunger is urged downwardly by a coil spring 118 telescoped over the stem 112 and compressed between the head 113 and the bushing 114.

Captivated within an elongated slot 120 (FIG. 24) in the hub 116 is a ball 121 which is urged toward the bottom of the slot by the head 113 of the plunger 111. The ball also is captivated against a cam surface 123 on the hub 117.

Figure 27:
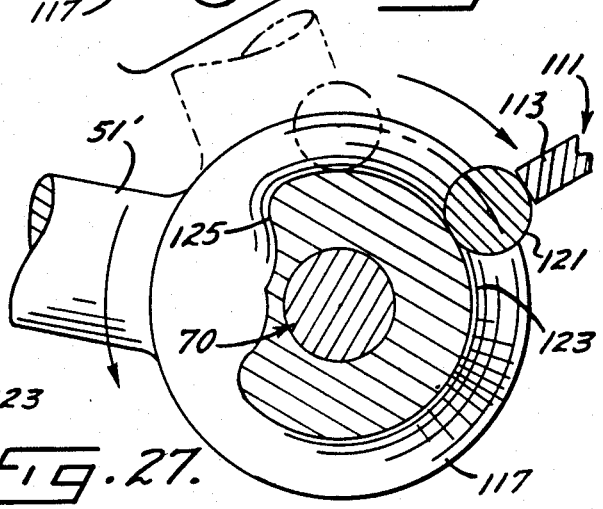
FIG. 27 is a view similar to FIG. 26 but shows certain parts in moved positions.

When the door 31 is moved to its fully open position as shown in FIG. 27, the links 51' and 52' are positioned relative to one another so as to cause the ball 121 to ride on the cam surface 123 and push the plunger 111 in a direction to load the spring 118. When the door is about 30 degrees from its fully closed position, the relative position of the links is such as to cause the ball 121 to encounter a fall 125 in the cam surface 123. As a result, the energy stored in the spring 118 causes the ball to cam against the fall and snap the door to its fully closed position. Because the self-closing force is exerted at the joint between the links 51' and 52', the stress imposed on the door and frame members 41' and 42' is relatively low. Also, the cup 43' of the door member 41' need not accommodate any part of the self-closing mechanism and thus may be of a simpler and more compact construction.

I claim:

1. Hinge means for supporting a door to swing in an arc relative to a frame about a predetermined hinge axis between a fully closed position and a fully open position, said hinge means comprising first and second members adapted to be secured rigidly to said door and frame, respectively, first and second links each having first and second end portions, means pivotally connecting the first end portion of said first link to said first member and supporting said first link to swing relative to said first member about a first axis which intersects said hinge axis at a predetermined point, means pivotally connecting the first end portion of said second link to said second member and supporting said second link to swing relative to said second member about a second axis which intersects said hinge axis at said point, means connecting the second end portions of said links together and supporting said end portions to pivot relative to one another about a third axis which intersects said point, and self-closing means carried by one of said links and acting against the second end portion of the other link to urge said door to said fully closed position after said door has been swung part way from said fully open position.

2. Hinge means as defined in claim 1 in which said self-closing means comprise a spring-loaded member located adjacent the second end portion of said one link, a cam surface located adjacent the second end portion of said other link, said spring-loaded member acting against said cam surface to effect self-closing of said door.

3. Hinge means as defined in claim 2 in which said one link is formed with a cavity extending lengthwise of the link, said self-closing means comprising a coil spring located within said cavity and acting against said spring-loaded member to urge the latter against said cam surface.

4. Hinge means as defined in claim 3 further including a cover for closing said cavity and concealing said spring.

5. Hinge means for mounting a door on a frame to swing in an arc and about a predetermined hinge axis between a fully closed position and a fully open position, said hinge means comprising a pair of hinges spaced from one another along said axis, each of said hinges comprising:

first and second members adapted to be secured rigidly to said door and said frame, respectively, first and second links each having first and second end portions, first means pivotally connecting the first end portion of said first link to said first member and supporting said first link to swing relative to said first member about a first axis which obliquely intersects said hinge axis at a predetermined point, second means pivotally connecting the first end portion of said second link to said second member and supporting said second link to swing relative to said second member about a second axis which obliquely intersects said hinge axis at said point, third means connecting the second end portions of said links together and supporting said end portions to pivot relative to one another about a third axis which intersects said point, said third means causing said first and second links to pivot about said first and second axes, respectively, in response to swinging of said first member and being located to cause said first member to swing in an arc about said hinge axis and to cause said first, second and third axes to remain in intersecting relation with said point during swinging of said first member, and self-closing means carried by one of said links and acting on the second end portion of the other link to urge said door to said fully closed position after said door has been swung part way from said fully open position.

6. Hinge means for mounting an upright door on an upright frame to swing in an arc through a predetermined angle from a fully closed position to a fully open position, said door and said frame having hinge mounting faces which are disposed substantially perpendicular to one another when said door is in said fully closed position, said hinge means comprising door and frame members adapted to be secured rigidly to the mounting faces of said door and said frame, respectively, door and frame links each having first and second end portions, first means pivotally connecting the first end portion of said door link to said door member and supporting said door link to swing relative to said door member about a first vertically inclined axis which is disposed in non-parallel relation with the mounting face of said door, second means pivotally connecting the first end portion of said frame link to said frame member and supporting said frame link to swing relative to said frame member about a second vertically inclined axis which is disposed in non-parallel relation with the mounting face of said frame and which intersects said first axis at a predetermined point when said door is in said fully closed position, third means connecting the second end portions of said links together and supporting such end portions to pivot relative to one another about a third axis which intersects said point when said door is in said fully closed position, said third means causing said door and frame links to pivot relative to said door and frame members, respectively, in response to swinging of said door and being located to keep all three of said axes in intersecting relation with said point during swinging of said door from said fully closed position to said fully open position, and self-closing means carried by one of said links and acting against the second end portion of the other link to urge said door to its fully closed position after said door has been swung part way toward its fully closed position.

7. The combination of, a cabinet having an upright door and an upright frame, and hinge means for mounting said door for swinging on said frame in an arc about a fixed and substantially vertical hinge axis from a fully closed position to a fully open position, said door and said frame having inside hinge mounting faces located in vertical planes which are disposed substantially perpendicular to one another when said door is in said fully closed position, said combination being characterized in that said hinge means comprise door and frame members adapted to be secured rigidly to the mounting faces of said door and said frame, respectively, door and frame links each having first and second end portions, first means pivotally connecting the first end portion of said door link to said door member and supporting said door link to swing relative to said door member about a first vertically inclined axis which extends obliquely through the plane of the mounting face of said door and which obliquely intersects said hinge axis at a predetermined point, second means pivotally connecting the first end portion of said frame link to said frame member and supporting said frame link to swing relative to said frame member about a second vertically inclined axis which extends obliquely through the plane of the mounting face of said frame and which obliquely intersects said hinge axis at said point, third means connecting the second end portions of said links together and supporting such end portions to pivot relative to one another about a third axis which intersects said point and which is inclined vertically when said door is in said fully closed position, said third means causing said first and second links to pivot about said first and second axes, respectively, in response to swinging of said door and being located to cause said door to swing in an arc about said hinge axis and to cause said first, second and third axes to remain in intersecting relation with said point during swinging of said door from said fully closed position to said fully open position, and self-closing means carried by one of said links and acting against the second end portion of the other link to urge said door to said fully closed position after said door has been swung part way from said fully open position.

8. The combination defined in claim 7 in which said door and frame members are located adjacent the upper end portion of said door and said frame, respectively, said first and second axes sloping downwardly as said first and second axes progress toward said point, said third axis sloping upwardly as said third axis progresses toward said point when said door is in said fully closed position and sloping downwardly as said third axis progresses toward said point when said door is in said fully open position.

9. The combination as defined in claim 8 in which said door and frame links extend downwardly from said door and frame members, respectively, when said door is in said fully closed position.

10. The combination as defined in claim 7 in which said door and frame members are located adjacent the lower end portion of said door and said frame, respectively, said first and second axes sloping upwardly as said first and second axes progress toward said point, said third axis sloping downwardly as said third axis progresses toward said point when said door is in said fully closed position and sloping upwardly as said third axis progresses toward said point when said door is in said fully open position.

11. The combination as defined in claim 10 in which said door and frame links extend upwardly from said door and frame members, respectively, when said door is in said fully closed position.

12. The combination of, a cabinet having an upright door and an upright frame, and upper and lower vertically spaced hinges for mounting said door for swinging on said frame in an arc about a fixed and substantially vertical hinge axis from a fully closed position to a fully open position, said door and said frame having inside hinge mounting faces located in vertical planes which are disposed substantially perpendicular to one another when said door is in said fully closed position, said combination being characterized in that each of said hinges comprises:

door and frame members adapted to be secured rigidly to the mounting faces of said door and said frame, respectively, door and frame links each having first and second end portions, first means pivotally connecting the first end portion of said door link to said door member and supporting said door link to swing relative to said door member about a first vertically inclined axis which extends obliquely through the plane of the mounting face of said door and which obliquely intersects said hinge axis at a predetermined point, second means pivotally connecting the first end portion of said frame link to said frame member and supporting said frame link to swing relative to said frame member about a second vertically inclined axis which extends obliquely through the plane of the mounting face of said frame and which obliquely intersects said hinge axis at said point, third means connecting the second end portions of said links together and supporting such end portions to pivot relative to one another about a third axis which intersects said point and which is inclined vertically when said door is in said fully closed position, said third means causing said first and second links to pivot about said first and second axes, respectively, in response to swinging of said door and being located to cause said door to swing in an arc about said hinge axis and to cause said first, second and third axes to remain in intersecting relation with said point during swinging of said door from said fully closed position to said fully open position, and self closing means carried by one of said links and acting on the second end portion of the other link to urge said door to said fully closed position when said door is swung part way from said fully open position, the door and frame links of said upper hinge extending downwardly from the door and frame members, respectively, of the upper hinge when said door is in said fully closed position, and the door and frame members of said lower hinge extending upwardly from the door and frame members, respectively, of the lower hinge when said door is in said fully closed position.

* * * * *